United States Patent [19]

Simko

[11] 4,093,332

[45] June 6, 1978

[54] POWER CONNECTOR

[75] Inventor: Paul S. Simko, Naperville, Ill.

[73] Assignee: Bunker Ramo Corporation, Oak Brook, Ill.

[21] Appl. No.: 527,927

[22] Filed: Nov. 27, 1974

Related U.S. Application Data

[63] Continuation of Ser. No. 426,156, Dec. 19, 1973, which is a continuation of Ser. No. 246,813, Jun. 21, 1972, abandoned.

[51] Int. Cl.[2] ..... H01R 25/02

[52] U.S. Cl. ..... 339/49 R; 339/91 R; 339/207 R

[58] Field of Search ..... 339/45, 47–49, 339/46, 75 P, 91 R, 59, 176 R, 186, 189, 214, 217, 205–208, 176 M, 176 S, 176 P, 60 R

[56] References Cited

U.S. PATENT DOCUMENTS

| | | | |
|---|---|---|---|
| 1,559,361 | 10/1925 | Parker | 339/91 R |
| 2,384,267 | 9/1945 | Anderson | 339/176 M X |
| 3,315,215 | 4/1967 | Kulka | 339/126 R |
| 3,440,596 | 4/1969 | Prompovicz | 339/49 R X |
| 3,519,977 | 7/1970 | Swearingen | 339/60 R X |
| 3,706,067 | 12/1972 | Hanson | 339/45 M |

FOREIGN PATENT DOCUMENTS

| | | | |
|---|---|---|---|
| 52,641 | 7/1890 | Germany | 339/47 R |
| 418,328 | 9/1925 | Germany | 339/49 R |

*Primary Examiner*—Roy Lake
*Assistant Examiner*—E. F. Desmond
*Attorney, Agent, or Firm*—William Lohff; F. M. Arbuckle

[57] ABSTRACT

A two-contact power connector made up of identical halves, each half having a base member and a pair of tubes, a large tube and a small tube, extending forwardly therefrom, with the small tube on each half telescoped in the large tube on the other half when the halves are connected. The contacts in the two halves are enshrouded by the telescoped tubes when the connector halves are connected, preventing accidental grounding. The contacts are releasably held by collet type retention members. Integral latching hooks are provided between the tubes, for releasably latching the connector halves together. One of the halves can be releasably mounted on a panel, thereby supporting the entire connector when the halves are connected.

5 Claims, 3 Drawing Figures

POWER CONNECTOR

This is a continuation, of application Ser. No. 426,156, filed Dec. 19, 1973, which is a continuation of Ser. No. 246,813, filed June 21, 1972, now abandoned.

OBJECTS OF THE INVENTION

A broad object of the invention is to provide a novel two-contact power connector, eliminating splicing and re-splicing of power cables.

Another broad object is to provide a hermaphrodite power connector, of novel construction including identical halves, resulting in unusually simple construction and in great economy of manufacture, as well as in installation thereof.

A still further object is to provide a power connector of the preceding general kind in which each half is made up of two molded parts, later secured together as by welding, the two halves enabling more simple design, and effective inter-relation between the elements of construction of each half, this resulting in still greater economy in the manufacture thereof.

An additional object is to provide a power connector of the foregoing general type including a pair of identical halves with contacts mounted in the halves, and including a novel construction incorporating telescoped tubes, and an arrangement in which the contacts, at their mutually interengaging portions, are enshrouded in the telescoped tubes, thus providing protection for the contacts and preventing accidental grounding thereof, and also wherein the telescoped tubes serve to polarize the connector halves when connected together.

Still anothr object is to provide a connector of the foregoing character, incorporating novel arrangement for releaseably mounting one of the halves to a panel, and for releaseably mounting contacts in the connector halves.

Still another object is to provide a connector made up of identical halves, and including contacts in the halves, and including additional arrangement for polarizing the halves by means of the special construction of the contacts.

Still another object is to provide a connector of the foregoing general character having novel and efficient latch means for latching the connector halves together, which are effective for holding the halves together under normal conditions, but which can readily be separated manually.

DESCRIPTION OF A PREFERRED EMBODIMENT:

Connectors of the general type involved in this invention, where identical halves or parts are utilized in the connector, i.e., each one having both male and female elements, have become quite generally known in the trade as "hermaphrodite" connectors.

Figure 1:
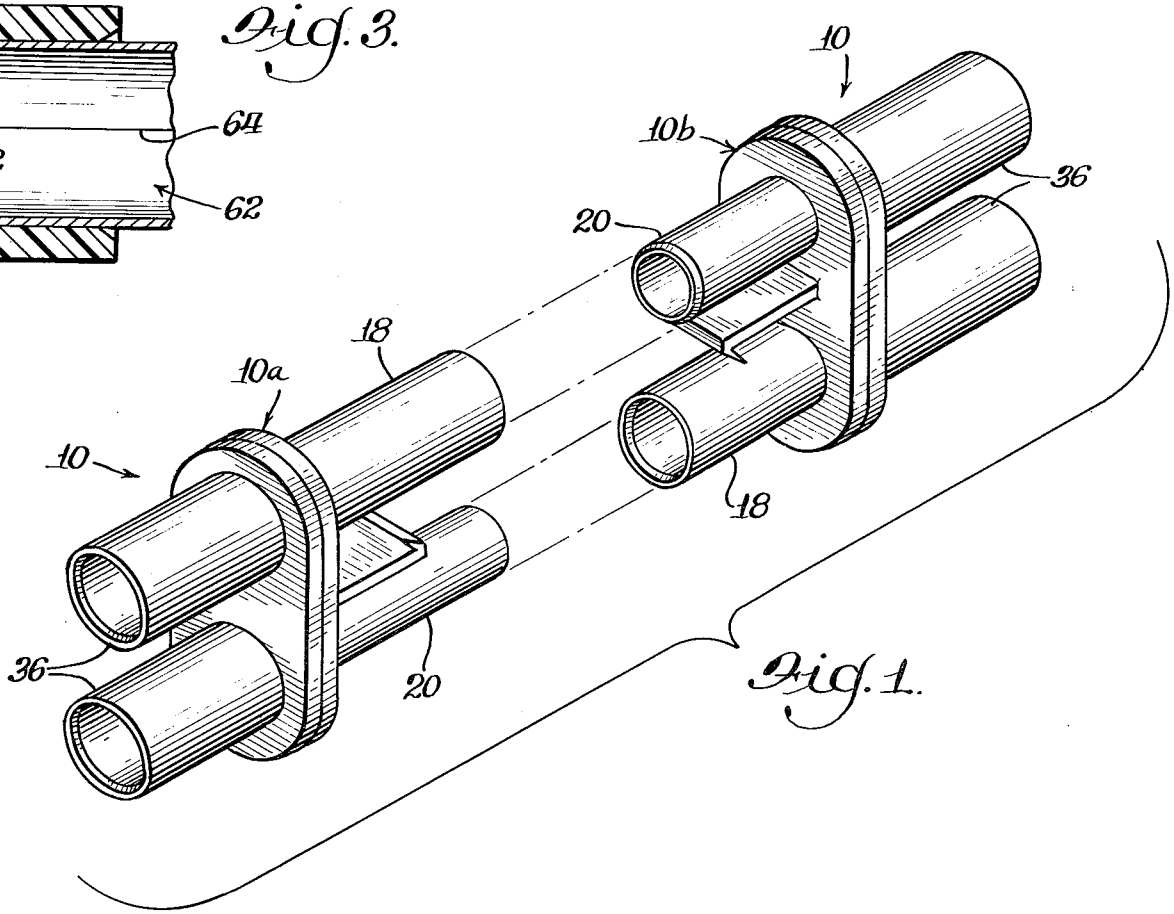
FIG. 1 is an exploded perspective view of the two identical halves of the connector in position for interconnection thereof.
Figure 2:
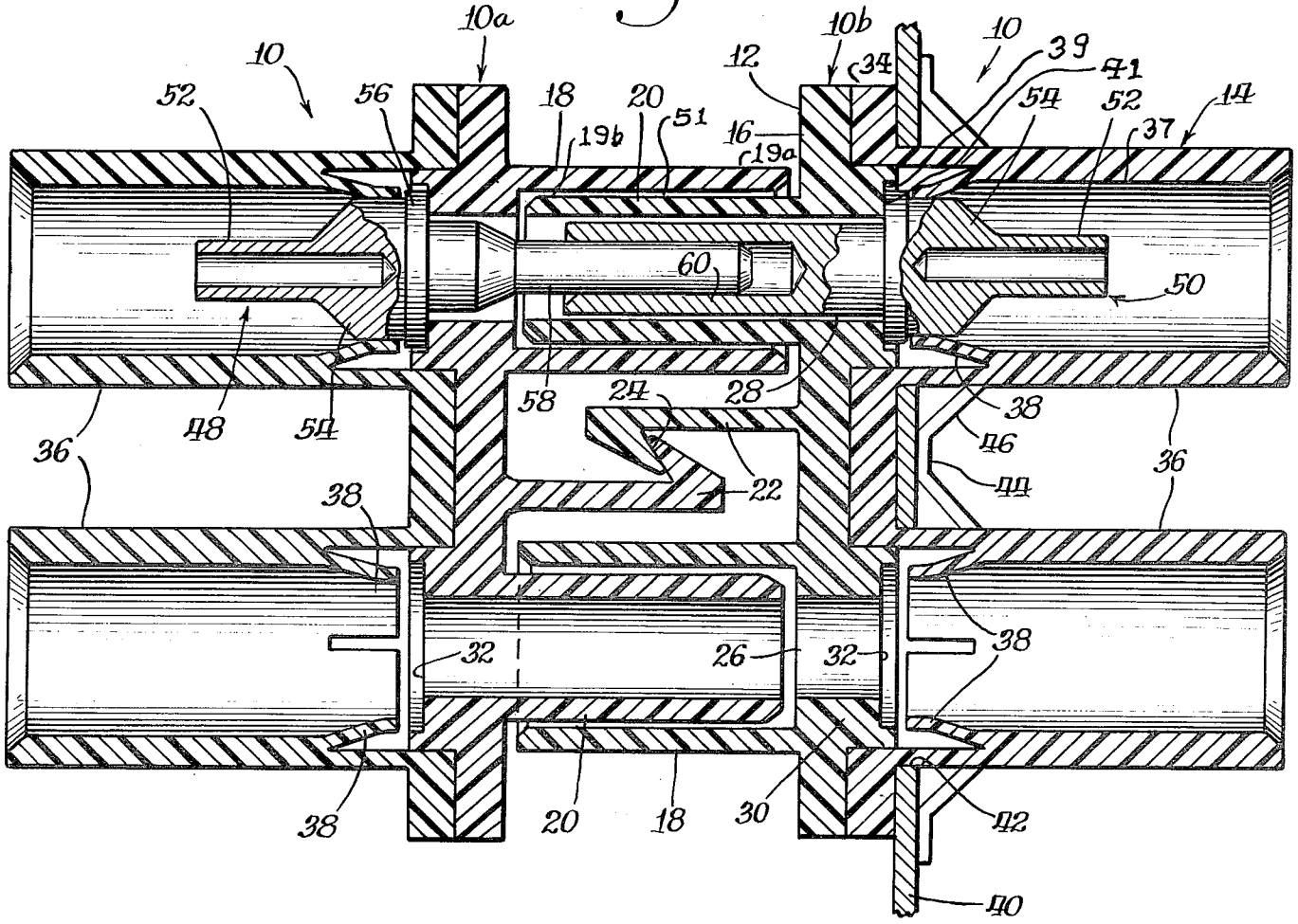
FIG. 2 is an axial sectional view, on a larger scale than that of FIG. 1, showing the two halves connected and showing contacts within the halves.

Referring in detail to the accompanying drawings, FIG. 1 shows two plural contact modular connector shell assemblies or connector halves which are identical in construction and in that view are arranged for interconnection by merely moving them together. FIG. 2 shows the same two connectors interconnected, and including two contacts mounted therein, this figure also showing a panel on which one of the connector halves is mounted. The two connector halves are indicated at 10 and for convenience individually identified **10*a* and 10*b*. The connector halves are of dielectric material, being molded from a suitable thermoplastic material. Each connector half is made from two parts or modules, each integral and molded separately but later connected together to render it unitary and effectively integral. The two parts are identified as a front part or mating part 12, and a rear or contact retention and support part 14. The part 12 has a plate-like base element 16 and a pair of transversely spaced elongated tubes 18 and 20, preferably of cylindrical shape extending forwardly therefrom. The tube 18 is of greater diameter than the tube 20** and when the connector halves are fitted together as referred to hereinbelow the smaller tube of each half is inserted into the larger tube of the other half, the tubes being of similar length and then being substantially completely telescoped.

The tubes 18, 20 communicate rearwardly through openings 26, 28 preferably of a diameter similar to the internal diameter of the smaller tube 20, these openings 26, 28 serving to receive contacts preferably identical in size as referred to hereinbelow.

Between the tubes 18, 20 is a thin, flexible and substantially flat latch hook or latch member 22 having an acute inside angle 24 formed by a rearwardly angled hook facing the large tube 18, these two hooks interengaging when the connector halves are fitted together for releaseably locking retaining them in connected condition. As illustrated in FIGS. 1-2, each latch hook 22 extends from the base member 16 with a length less than the length of tubes 18 or 20 and include an outer hook portion with acute angle 24. Latch hook 22 is flexible transversely to permit transverse deflection of the hook portion as the hook portions slide along each other during mating of the connector halves during which the hook portions become engaged together in a releasable locking relation. The tubes 18, 20 and the latch hook 22 are integral with the base element 16.

The base element 16 extends beyond the tubes 18, 20 and is provided with rearwardly extending flanges 30 surrounding the opening 26, 28 each having an annular counter bore or recess 32 for cooperation with the contacts as referred to below.

Each rear part 14 also includes a plate-like flange or base element 34 fitted to the base element 16 and secured firmly thereto as by ultrasonic welding, the two parts 12 and 14 then becoming unitary and effectively integral. Extending from the plate element 34 are rear tubular elements 36 receiving the flanges 30 and in line with the corresponding tubes 18, 20 and forming tubular extensions thereof. The rear tubular extensions 36 at their inner ends are provided with a plurality of forwardly extending tines 38, in this case four, formed from the material of the part 14, in the molding thereof. These tines extend inwardly and possess a substantial degree of resilience or springiness for use in holding the contacts in place in the connector half. The tubes 36 are spaced and sized for registration and receipt in respective panel openings and register or are in axial alignment with tubes 18 and 20.

The connector may suitably be mounted on a panel 40 which has a corresponding number of apertures or holes 42 for receiving the rear tubular extensions 36, this panel being abutted by the back side of the base element 34. Suitable clips 44 are fitted over the tubular extensions 36 these clips having spring fingers 46 which engage the outer surfaces of the extensions 36 and retain the connector half **10*b*** in place on the panel, and thus retain the whole connector when the two halves are connected together.

Figure 3:
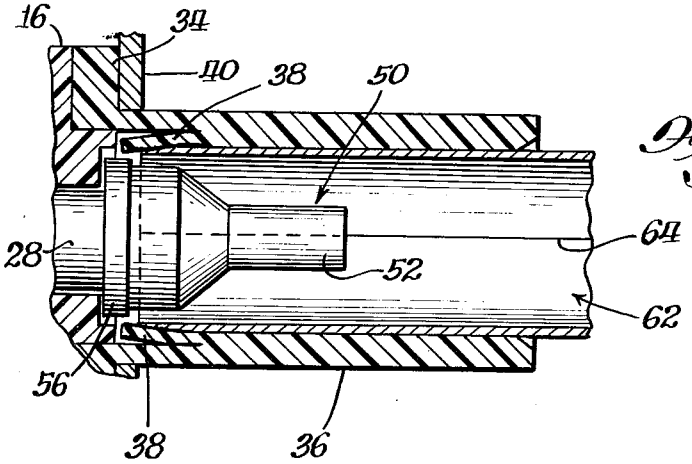
FIG. 3 is a semi-diagrammatic view of one portion of the illustration of FIG. 2 showing how a tool is used for removing a contact from the connector half.

FIG. 2 shows a pin contact 48 and a socket contact 50, in place in the connector halves, and interconnected. These contacts have identical rear portions, each including a tubular element 52 for receiving a conductor on which the element is crimped. The element 52 merges into an enlarged portion 54 having at its inner end a disc 56 of greater diameter than the enlarged portion 54 and fitted in the annular recess 32. The pin contact 48 in the larger tube 18 has a pin element or male element 58 while the contact 50 in the smaller tube 20 is a socket contact having a socket element or female element 60. These contacts are inserted into the corresponding connector halves from the outer ends of the rear tubular elements 36, the discs 56 springing the fingers 38 outwardly, and when the discs pass the fingers, the fingers spring back into position engaging the outer end surface of the respective disc, forming a positive stop means preventing accidental displacement or removal of the contact. However these fingers can be sprung radially outwardly beyond the discs for removing the contacts, by a suitable tool 62 (FIG. 3) which is put in position around the contact and moved inwardly in the tubular element, and is of proper diameter to engage the fingers 38 and spring them outwardly and enable removing the contact. The tool 62 has a longitudinal part or split 64 enabling the tool to be put around the contact.

The telescoping tubes 18, 20 provide polarization of the connector halves, as will be understood since the smaller tubes must be inserted in the larger tubes. These tubes as indicated above are substantially completely telescoped, and the working ends of the contacts 48, 50 have mutual interengagement within the tubes, and the tubes thus provide protection to the contacts, preventing accidental grounding, or possible mechanical damage.

The contacts 48, 50 may also be considered a means for providing polarization, but except for the actual telescoping pin and socket elements of the contacts, the contacts are identical and either of them may be placed in either connector half.

The latch hooks 22, as indicated above interengage when the connector halves are moved toward each other in connecting direction, normally retaining the connector halves in connected condition, but they can be disconnected manually, by a screw driver, enabling the connector halves to be separated.

The construction is extremely simple and inexpensive. The connector is made entirely of plastic material, and each half is essentially integral, the base elements 16 and 34 being welded. The latch hooks 22 being integral with the base element 16 and 34, provide a further point of simplicity and economy, and are effective for normally holding the connector halves together but enabling separation when that is desired; the contacts are effectively enclosed in the connector - the elements 48 and 60 being entirely enclosed or enshrouded in the telescoped tubes 18, 20 and these tubes being of substantial dimensions provide great strength to the connectors. Additionally, the outer end portions of the contacts 48, 50 are substantially enclosed in the rear tubular elements 36, the latter being of greater length than the outer portions of the contacts, providing protection against mechanical damage to the contacts at these locations. Thus, contacts 48, 50 are recessed below the ends of tubes 18, 20, and tubular elements 36.

Thus it is seen in the connector of the invention that connector halves **10*a* and 10*b* are capable of being fitted together with their forward ends 19*a* and 19*b* of tubes 18 and 20 interfitted with the small tube 20 on one half 10*a* being positioned in the large tube 18 on the other half 10*b*, the contacts 48 and 50 thereby having interfitting telescoping relationship throughout a substantial portion of the telescope portions represented by portion 51 of tube 20**.

Each connector half is also provided with a latch member between tubes 18 and 20 integral with each connector half. In the preferred embodiment, the latch member is illustrated by latch hook 22 integral with front base member 16 and recessed below the forward ends of tubes 18, 20.

Tubes 18 and 20 communicate with rear tubular elements 36 through respective openings 26 and 28 of substantially lesser diameter than the internal diameter 37 of rear tubular elements 36. In this arrangement, shoulders 39 are formed around those openings 26 and 28 on base member 16. Contacts 48 and 50 are each provided with disc 56 of greater diameter than openings 26 and 28 to form shoulders 41 engaging shoulders 39 on the base member. As illustrated in FIG. 2, the inwardly extending tines 38 include free-ended portions which are essentially parallel to and bear against enlarged tubular portion 54.

The connector is thereby capable of accommodating contacts 48 and 50 with different sized tubular elements 52 adapted to receive conductors of appropriate size. The connector tubes also provide protection for contacts 48 and 50 preventing accidental grounding or possible mechanical damage and in addition serve to stabilize each of the two connector halves against transverse displacement to avoid accidental release of the latching hooks.

I claim:

1. A connector comprising a pair of identical halves, each half including a plate-like base member, and a pair of transversely-spaced, elongated tubes extending forwardly therefrom to forward ends, the tubes being of different diameters, and a pair of tubular elements rearwardly extending to rear ends with substantially equal internal diameters and in communication with said tubes, the halves being capable of being fitted together with their forward ends interfitted and the small tube on each half being positioned in the large tube on the other half, and the respective tubes then being substantially completely telescoped, each half also including a latch hook integrally formed with each base and disposed between the tubes and recessed below the forward ends of the tubes, each latch hook including a hook angled rearwardly and facing the large tube, the latch hooks being interconnected in a releasable locking relation when the halves are fitted together, and each connector half also including contacts with elements extending into but recessed below the tubes and tubular elements, and making mutual contact engagement within respective telescoped tubes, wherein the base member is made up of front and rear base members permanently secured together with the tubes and tubular elements being integral with the front and rear members, respectively, wherein the tubes communicate with said rear tubular elements through openings of substantially lesser diameter than the internal diameter of the rear tubular elements thereby forming shoulders around those openings on the base member, and said contacts have outer portions of greater diameter than said openings forming shoulders thereon engaging said shoulders on the base member and tubular portions extending rearwardly from said shoulders, and the rear tubular portions have spring tines biased radially inwardly against said tubular portions, normally retaining the contacts in position, but being capable of being flexed outwardly to release the contacts to enable withdrawal of the contacts out through said rear tubular elements.

2. A connector according to claim 1 wherein said openings between the tubes and the rear tubular elements are of substantially the same inner diameter, and the contacts at their outer portions are identical, whereby to enable any of the contacts to be utilized in either of the connector halves.

3. A connector according to claim 2 wherein said spring tines extend inwardly to free-ended portions essentially parallel to the tubular portions for stabilizing said contact.

4. A connector according to claim 3 in conjunction with a mounting panel and wherein each connector half has a rear tubular element in line with each tube, the panel has a plurality of apertures corresponding to said rear tubular elements, whereby the connector may be mounted on the panel by inserting the rear tubular elements on one of the connector halves through said apertures, with the base member engaging the panel, and the construction also including retaining clips surrounding the rear tubular elements, and engaging the panel on the side of the panel opposite the base member, and having spring fingers engaging the outer surface of the rear tubular elements that extend through the panel, whereby to support the corresponding one of the connector halves, and thereby supporting the complete connector, on the panel when the halves are connected together.

5. A plural contact modular connector shell assembly for use in supporting a modular connector shell assembly of identical construction from a panel having a plurality of spaced openings comprising:

a plurality of contacts;

a first module of dielectric material including a first flange having a plurality of integrally formed first tubes projecting in one direction therefrom with said tubes spaced and sized for registering with a respective one of said panel openings to enable the receipt and securing of each tube in a respective opening with said flange abutting one face of said panel and with said module having resilient means integrally formed for each tube for engaging each of said contacts in response to the receipt of a portion of a respective contact in a respective first tube to limit movement of the respective contact in said one direction relative to the axis of the respective tube;

a second module of dielectric material including a second flange secured to said first flange with said flange having a plurality of integrally formed second tubes each of a different size projecting from said second flange in a direction opposite said one direction and each spaced for registration with a respective one of said first tubes for receiving another portion of a respective contact of said plurality of contacts with means integrally formed on said second module for engagement with each contact to hold the respective contact against movement in said opposite direction in response to said second flange being secured to said first flange with each contact received in the respective aligned tubes;

and latch means integrally formed on said second module for engaging corresponding latch means formed on the second module of said other connector shell assembly of modular construction to prevent axial disengagement of said assemblies in response to the telescoping engagement of a respective second tube of said first module with a correspondingly sized respective second tube of the second module of said other shell assembly to support said other shell assembly from said panel with each contact engaged with a respective contact of said other shell assembly.

* * * * *